US007513602B2

(12) United States Patent
Nishijima

(10) Patent No.: US 7,513,602 B2
(45) Date of Patent: Apr. 7, 2009

(54) COATING METHOD, LIQUID SUPPLYING HEAD AND LIQUID SUPPLYING APPARATUS

(75) Inventor: Tatsumi Nishijima, Chino (JP)

(73) Assignee: Seiko Epson Corporation (JP)

( * ) Notice: Subject to any disclaimer, the term of this patent is extended or adjusted under 35 U.S.C. 154(b) by 333 days.

(21) Appl. No.: 11/305,469

(22) Filed: Dec. 16, 2005

(65) Prior Publication Data

US 2006/0132541 A1 Jun. 22, 2006

(30) Foreign Application Priority Data

Dec. 17, 2004 (JP) ..... 2004-366055

(51) Int. Cl.
*B41J 2/14* (2006.01)
*B41J 2/135* (2006.01)

(52) U.S. Cl. ..... 347/47; 347/45

(58) Field of Classification Search ..... 347/45, 347/47; 427/487

See application file for complete search history.

(56) References Cited

U.S. PATENT DOCUMENTS 6,813,831 B2 * 11/2004 Kamei et al. ..... 29/890.1
2004/0207797 A1 * 10/2004 Sakurada ..... 349/153

FOREIGN PATENT DOCUMENTS

| | | |
|---|---|---|
| JP | 06-171081 | 6/1994 |
| JP | 07-125220 | 5/1995 |
| JP | 09-267478 | 10/1997 |
| JP | 2003-154663 | 5/2003 |
| KR | 2004-0069748 | 8/2004 |

* cited by examiner

*Primary Examiner*—An H Do
(74) *Attorney, Agent, or Firm*—Harness, Dickey & Pierce, P.L.C.

(57) ABSTRACT

A coating method is provided for forming a liquid-repellent coat on a predetermined partial region of an inner surface of each through-hole of a nozzle plate. The nozzle plate is provided in an ink-jet head of an ink-jet printer. The coating method comprises the steps of forming a coat preform to be processed into the coat on a region including the partial region of the inner surface of the through-hole; attaching a sheet material for protecting the coat preform to one surface of the base material in which the one end of the through-hole is provided so that a part of the sheet material is packed into the through-hole; subjecting the base material to plasma processing and/or ultraviolet ray irradiating processing from the side of the base material where the other end of the through-hole is provided to remove the coat preform exposed from the sheet material while leaving the coat preform on the predetermined partial region as it is; and removing the sheet material from the base material. A liquid supplying head having the thus formed nozzle plate and a liquid supplying apparatus equipped with the liquid supplying head are also provided.

7 Claims, 6 Drawing Sheets

COATING METHOD, LIQUID SUPPLYING HEAD AND LIQUID SUPPLYING APPARATUS

CROSS-REFERENCE

The entire disclosure of Japanese Patent Application No. 2004-366055 filed on Dec. 17, 2004 is expressly incorporated by reference herein.

BACKGROUND OF THE INVENTION

1. Field of the Invention

The present invention relates to a coating method, a liquid supplying head and a liquid supplying apparatus.

2. Description of the Prior Art

An ink-jet head (liquid supplying head) is provided with a nozzle plate which has a plurality of minute nozzle holes mutually spaced apart with a narrow spacing left therebetween. The ink-jet head is designed to perform printing operations by ejecting ink droplets from apertures (ink-ejecting apertures) formed at one side of the nozzle holes and landing the ink droplets on a printing paper. In such an ink-jet head, once ink is adhered to a surface of the nozzle plate at the side where the ink-ejecting apertures lie, the flight trajectory of the ink droplets ejected next time becomes flexed under the influence of surface tension or viscosity of the adhered ink. This makes it difficult for the ink droplets to be landed on target spots. Taking this into account, an attempt has been made to form a liquid-repellent coat which consists of a fluorine-based resin or the like. In this attempt, the liquid-repellent coat is formed on an ink ejecting aperture-side surface of the nozzle plate, and further on a predetermined region (which is adjacent to the ink ejecting aperture) of an inner surface of each nozzle hole. This type of liquid-repellent coat is formed in the following manner, as taught in JP-A No. 1995-125220, for example.

A nozzle plate is prepared first, and a photosensitive resin film which is curable by irradiation of light is laminated on the opposite surface of the nozzle plate from ink-ejecting apertures. Subsequently, the laminated resin film is heated while applying pressure on the film. Thus, the photosensitive resin film is heat-and-pressure bonded to the rear surface of the nozzle plate, and at the same time those parts of the photosensitive resin film facing to the nozzle holes are caused to enter the individual nozzle holes.

Then, ultraviolet rays are irradiated onto the photosensitive resin film to cure the latter. Subsequently, the nozzle plate is dipped and agitated in an electrolysis solution which contains nickel ions and a fluorine resin dispersed by electric charges. In this way, an eutectoid plating layer is formed on the part of the nozzle plate not covered with the photosensitive resin film, i.e., on the ink ejecting aperture-side surface of the nozzle plate and on the inner surface parts of the nozzle holes adjacent to the ink-ejecting apertures. Finally, the photosensitive resin film is dissolved and removed by use of a solvent, after which the nozzle plate is heated at a temperature no greater than the melting point of the fluorine resin contained in the eutectoid plating layer.

Through the process described above, a liquid-repellent coat is formed on the ink ejecting aperture-side surface of the nozzle plate and on the predetermined region (which is adjacent to the ink-ejecting apertures) of the inner surface of each nozzle hole. However, this method involves following problems.

The method described above employs the photosensitive resin film. Therefore, even for the regions of the nozzle plate that do not require formation of the liquid-repellent coat, it is required to perform the steps of: bonding a photosensitive resin film to a nozzle plate by heat and pressure; curing the photosensitive resin film; and dissolving and removing the photosensitive resin film.

Not only these steps involve complexity but also they require installations for carrying out each of the steps. In addition, the photosensitive resin film is inherently expensive, which in turn increases production costs.

SUMMARY OF THE INVENTION

In view of the problems in the prior art described in the above, it is an object of the present invention to provide a coating method that can form a coat on a predetermined partial region of an inner surface of each through-hole of a base material, with the use of simplified steps and installations in a cost-effective manner.

Another object of the present invention is to provide a liquid supplying head provided with a nozzle plate that has a liquid-repellent coat formed by the coating method.

A further object of the present invention is to provide a liquid supplying apparatus that is equipped with the liquid supplying head.

In order to achieve the above object, the present invention is directed to a coating method for forming a coat on a base material having at least one through-hole, the through-hole having an inner surface between one end and the other end thereof, the coat being formed on at least a predetermined partial region of the inner surface of the through-hole, the partial region of the inner surface running a predetermined length from the one end of the through-hole toward the other end, the method comprising the steps of: forming a coat preform to be processed into the coat on a region including the partial region of the inner surface of the through-hole; attaching a sheet material for protecting the coat preform to one surface of the base material in which the one end of the through-hole is provided so that a part of the sheet material is packed into the through-hole; subjecting the base material to plasma processing and/or ultraviolet ray irradiating processing from the side of the base material where the other end of the through-hole is provided to remove the coat preform exposed from the sheet material while leaving the coat preform on the predetermined partial region as it is; and removing the sheet material from the base material by peeling off the sheet material from the base material.

This method makes it possible to form the coat on the predetermined partial region of the inner surface of the through-hole of the base material with simplified steps and installations in a cost-effective manner.

In the coating method according to the present invention, it is preferred that the coat preform is formed from a liquid which contains a constituent of the coat. The method (liquid-phase coating method) using such a liquid makes sure that the coat preform is formed in an easy and reliable manner.

In the coating method according to the present invention, it is preferred that in the coat preform forming step the part of the sheet material is packed into the through-hole so that the sheet material covers the coat preform provided on a region of the inner surface of the through-hole which includes the predetermined partial region, and in the plasma and/or ultraviolet ray irradiating processing subjecting step, while removing the sheet material which covers the coat preform other than the partial region by the plasma and/or ultraviolet ray irradiating processing, the coat preform exposed from the sheet material is removed.

This makes it possible to expand the range of choices for materials that can be used for the sheet material.

Further, in the coating method according to the present invention, it is also preferred that the plasma and/or ultraviolet ray irradiating processing is carried out under an atmospheric pressure. This eliminates the need for a vacuum pump, which helps to reduce the costs involved in producing the coat.

Furthermore, in the coating method according to the present invention, it is also preferred that the plasma and/or ultraviolet ray irradiating processing is carried out under a reduced pressure. According to this coating method, in a case where the plasma processing is carried out under the reduced pressure, it is possible to generate plasma easily and reliably, and in a case where the ultraviolet ray irradiation processing is carried out under the reduced pressure, it is possible to reduce an amount of vapor within the ambient atmosphere in which the processing is carried out, it is possible to prevent appropriately the irradiated ultraviolet rays from being absorbed by the vapor to be attenuated. Further, since the decomposed matter of the coat preform is likely to spread into the ambient atmosphere, it is possible to remove the decomposed matter of the coat preform more reliably.

Furthermore, in the coating method according to the present invention, it is also preferred that an average area of the through-hole at the one end thereof is 50-40,000 $\mu m^2$. The coating method of the present invention can be advantageously employed in forming the coat on the inner surface of the through-hole that has such an ultra fine size. This allows the coat to be easily and reliably formed on the predetermined partial region of the inner surface of the through-hole.

Moreover, in the coating method according to the present invention, it is also preferred that the sheet material has stickiness or adhesiveness. By using such a sheet material having stickiness or adhesiveness in itself, it is possible to attach the sheet material to the base material reliably. In particular, by using a sheet material having stickiness in itself, it is possible to detach or remove the sheet material from the base material easily and reliably in the sheet material removing step described above.

Moreover, in the coating method according to the present invention, it is also preferred that in the coat preform forming step the coat preform is formed on the inner surface of the through-hole and the external surface of the base material so that the coat is formed on the partial region of the inner surface of the through-hole and the one surface of the base material in a continuous manner.

Another aspect of the present invention is directed to a liquid supplying head, comprising: a main body provided with a nozzle plate formed from the base material processed by the coating method of Claim 1, the nozzle plate having at least one flow passageway for allowing a liquid to pass therethrough in which the flow passage way is formed from the through-hole, the flow passageway having an opening corresponding to the one end of the through-hope which constitutes an outlet aperture from which the liquid is discharged; and a liquid-repellent coat formed in a manner that the liquid-repellent coat extends continuously on the partial region of the inner surface of the flow passageway and further on the one surface of the nozzle plate of the main body in which the outlet aperture is provided. According to the invention described above, it is possible to provide a liquid supplying head that can supply a liquid to target spots reliably and uniformly.

In this liquid supplying head, it is preferred that the liquid supplying head further comprises a liquid droplet ejecting means for ejecting the liquid from the outlet aperture in the form of droplets.

Other aspect to the present invention is directed to a liquid supplying apparatus equipped with the liquid supplying head described above. This liquid supplying apparatus is capable of reliably and uniformly supplying the liquid to target spots.

These and other objects, structures and advantages of the present invention will be apparent more clearly from the following description of the invention based on the examples.

DETAILED DESCRIPTION OF THE PREFERRED EMBODIMENTS

A coating method, a liquid supplying head and a liquid supplying apparatus according to the present invention will be described hereinbelow with reference to the accompanying drawings which show a preferred embodiment.

First of all, description is made with regard to an embodiment of an ink-jet head which incorporates the liquid supplying head of this invention. Although an ink-jet head employing an electrostatic driving system is described in the present embodiment by way of example, it should be noted that the invention is not limited to the ink-jet head disclosed herein, but may be applied to other types of ink-jet heads, e.g., a piezoelectric driving type ink-jet head.

Figure 1:
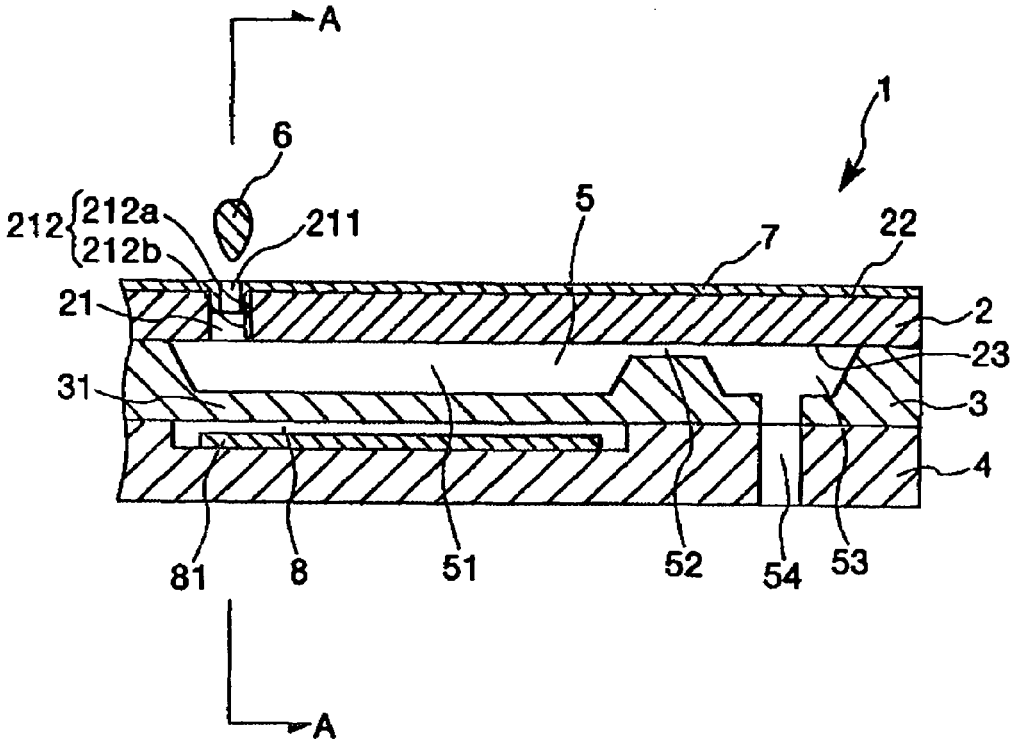
FIG. 1 is a vertical section view showing an embodiment of an ink-jet head which incorporates a liquid supplying head according to the present invention.

FIG. 1 is a vertical section view showing an embodiment of the ink-jet head which incorporates the liquid supplying head of this invention. In this drawing, the ink-jet head is shown upside down as compared to its normal use condition. For the sake of convenience in description, the upper side in FIG. 1 is referred to as "top", "upper" or its equivalents, and the lower side is referred to as "bottom", "lower" or its equivalents.

The ink-jet head 1 shown in FIG. 1 is of an electrostatic driving type. This ink-jet head 1 is provided with a main body having a nozzle plate 2, a cavity plate 3 and an electrode plate 4. In the main body, the cavity plate 3 is sandwiched between the nozzle plate 2 and the electrode plate 4.

A plurality of steps are formed on the cavity plate 3, so that a gap 5 is defined between the nozzle plate 2 and the cavity plate 3. The gap 5 includes a plurality of mutually separated ink-ejecting chambers 51; orifices 52 formed at the rear sides of the respective ink-ejecting chambers 51; and a common reservoir 53 for feeding ink to each of the ink-ejecting chambers 51. An ink inlet port 54 is formed at the bottom of the reservoir 53. Those parts of the cavity plate 3 facing the ink-ejecting chambers 51 are thin-walled, so that each of them can serve as a vibration diaphragm 31 for changing the pressure within the corresponding ink-ejecting chamber 51.

A plurality of nozzle holes (through-holes) 21 are formed through the nozzle plate 2 so as to respectively communicate with the ink-ejecting chambers 51. Each of the nozzle holes 21 acts as a flow passageway through which the ink (liquid) can be discharged from the ink-ejecting chamber 51. The opening formed at the upper side (one side) of each of the nozzle holes 21 constitutes an ink-ejecting aperture (outlet aperture) 211 through which the ink is ejected in the form of ink droplets (liquid droplets) 6.

A liquid-repellent coat 7 is formed on an external surface 22 of the nozzle plate 2 which lies at the same side as the ink-ejecting aperture 211. In addition, the liquid-repellent coat 7 is also formed on a partial region 212*a* (that is, a predetermined region adjacent to the ink-ejecting aperture 211) of an inner surface 212 of each nozzle hole 21. The liquid-repellent coat 7 mentioned above is formed in such a manner that it can extend continuously over the external surface 22 and over each partial region 212*a*. In this connection, it should be noted that in this embodiment the term of "partial region" means a predetermined region of the inner surface 212 which runs a predetermined length (depth) from the top end (one end) of the nozzle hole 21 toward the bottom end (the other end).

The liquid-repellent coat 7 is a coat that exhibits greater repellency against the ink. The liquid-repellent coat 7 formed in this manner prohibits the ink from adhering to the periphery of each of the ink-ejecting apertures 211, thus assuring that the ink droplets 6 can be sprayed in a direction substantially coinciding with an axis of each of the nozzle holes 21.

In case of forming a water-repellent coat as one type of the liquid-repellent coat 7, various kinds of water-repellent resin materials may be used. Examples of such water-repellent resin materials include various kinds of coupling agents with water-repellent functional groups such as a fluoroalkyl group, an alkyl group, a vinyl group, an epoxy group, a styryl group and a metacryloxy group; fluorine-based resins such as polytetrafluoroethylene (PTFE), tetrafluoroethylene-perfluoroalkylvinylether copolymer (PFA), ethylene-tertafluoroethylene copolymer (ETFE), perfluoroethylene-propene copolymer (FEP), ethylene-chlorotrifluoroethylene copolymer (ECTFE) and perfluoroalkylether; and a silicon resin. Further, various kinds of hydrophilic resin materials may be used. Examples of such hydrophilic resin materials include various kinds of coupling agents having functional groups such as a hydroxyl group, a carboxyl group and an amino group; and polyvinyl alcohol, and the like.

Average thickness of the liquid-repellent coat 7 should preferably be, but is not particularly limited to, in the range of about 0.001-5 μm.

The coating method according to the present invention is employed in forming the liquid-repellent coat 7 mentioned above. Description will be given later regarding the method of forming the liquid-repellent coat 7 (that is, an embodiment of the coating method of the present invention).

Average area of the ink-ejecting aperture 211 (the opening at the one end of each of the nozzle holes 21) should preferably be, but is not particularly limited to, in the range of about 50-40,000 $\mu m^2$. It is preferred that the coating method of this invention is employed in order to form the liquid-repellent coat 7 on the inner surface 212 of each of the nozzle holes 21 having such a small diameter as described above. This ensures that the liquid-repellent coat 7 can be easily and reliably formed on the partial region 212*a* of the inner surface 212 of each of the nozzle holes 21.

In the ink-jet head 1 shown in FIG. 1, the electrode plate 4 is bonded to the cavity plate 3 at the side opposite to the nozzle plate 2, so that the cavity plate 3 is sandwiched between the nozzle plate 2 and the electrode plate 4. The electrode plate 4 has recesses at its portions facing the vibration diaphragms 31 so that vibration chambers 8 can be defined between the electrode plate 4 and the vibration diaphragms 31. At the bottom of each vibration chamber 8, an electrode 81 is provided on the electrode plate 4 so as to face the corresponding vibration diaphragm 31. In this configuration, the vibration diaphragms 31, the vibration chambers 8 and the electrodes 81 cooperate with one another to provide an electrostatic actuator (liquid droplet ejecting means).

In this type of ink-jet head 1, when pulse voltages are applied to the electrodes 81 by means of a signal generating circuit, the surfaces of the electrodes 81 are positively charged, while the corresponding lower surfaces of the vibration diaphragms 31 are charged with negative potential. In response, the vibration diaphragms 31 are bent downwardly by the attracting force of the static electricity generated in this process. Then, when the pulse voltages are cut off under this state, the electric charges gathered in the electrodes 81 and the vibration diaphragms 31 are rapidly discharged, and hence each of the vibration diaphragms 31 is restored substantially to its original shape by its resilient force. At this moment, the pressure within the ink-ejecting chambers 51 soars up drastically to thereby cause the ink droplets to be ejected toward a sheet (printing paper P) through each of the nozzle holes 21. Then, when the vibration diaphragms 31 are caused to be bent downwardly once again, the ink in the reservoir 53 is supplemented to the ink-ejecting chambers 51 through the respective orifices 52.

The ink-jet head 1 described above can be produced through the following process for example.

Figure 2:
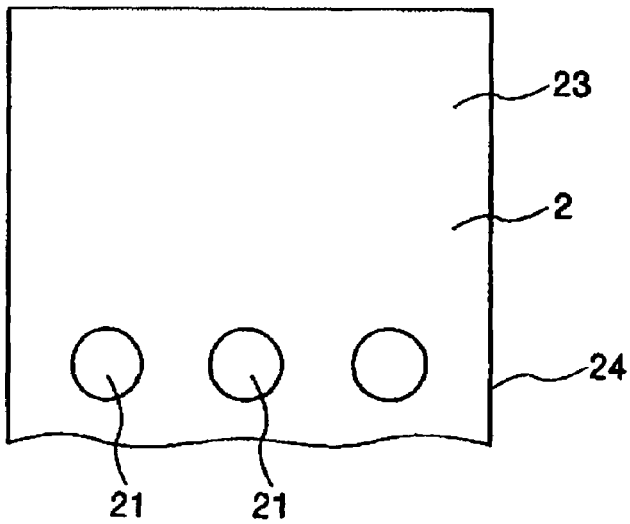
FIG. 2 is a view which illustrates a method of producing the ink-jet head shown in FIG. 1.
Figure 3:
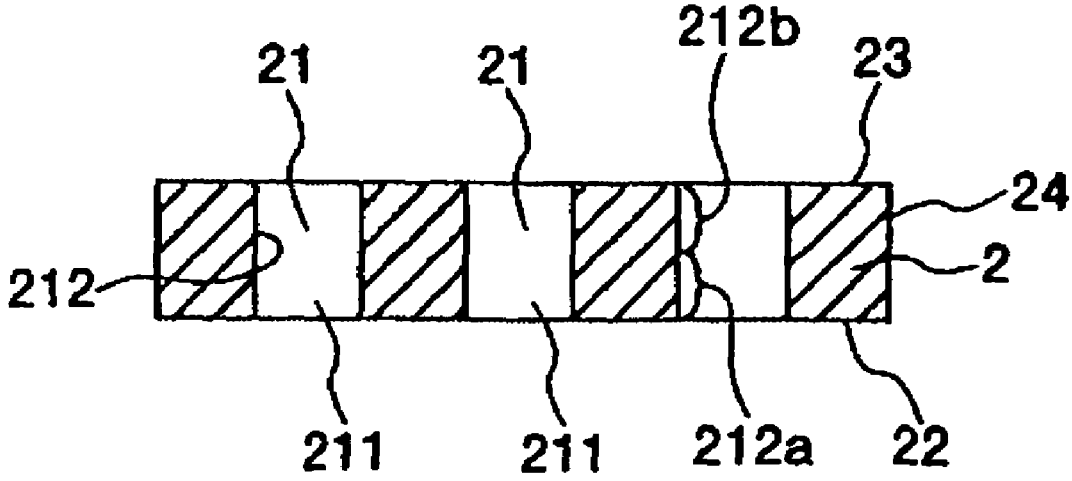
FIG. 3 is a view which illustrates a method of producing the ink-jet head shown in FIG. 1.
Figure 4A:
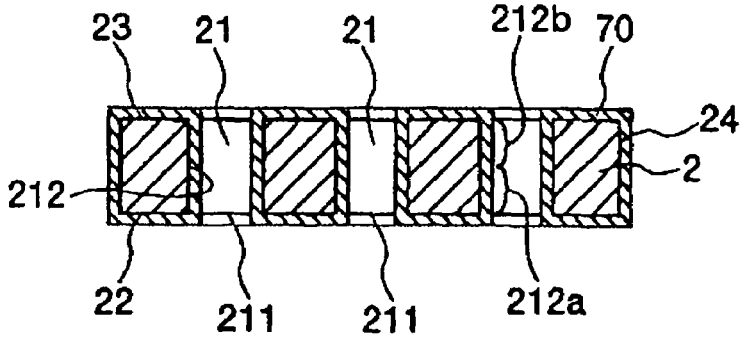
FIG. 4 is a view which illustrates a method of producing the ink-jet head shown in FIG. 1.
Figure 4B:
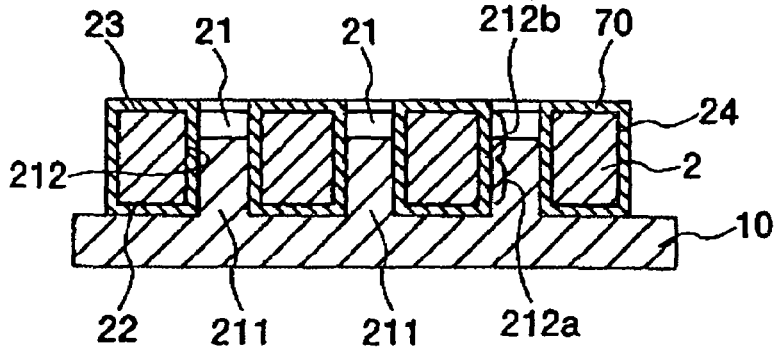
Figure 4C:
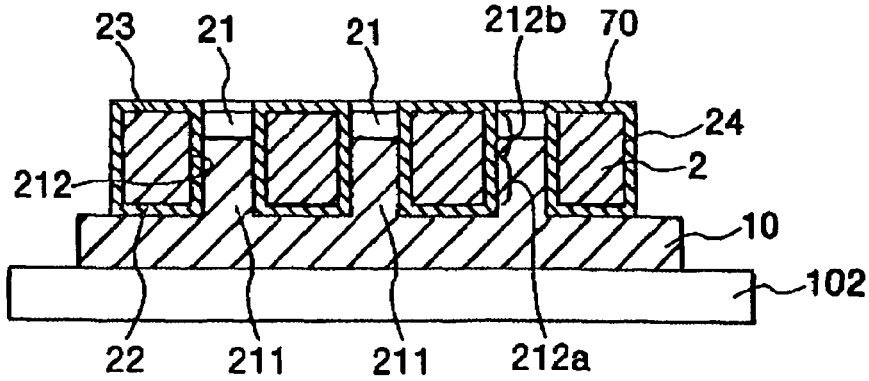
Figure 5:
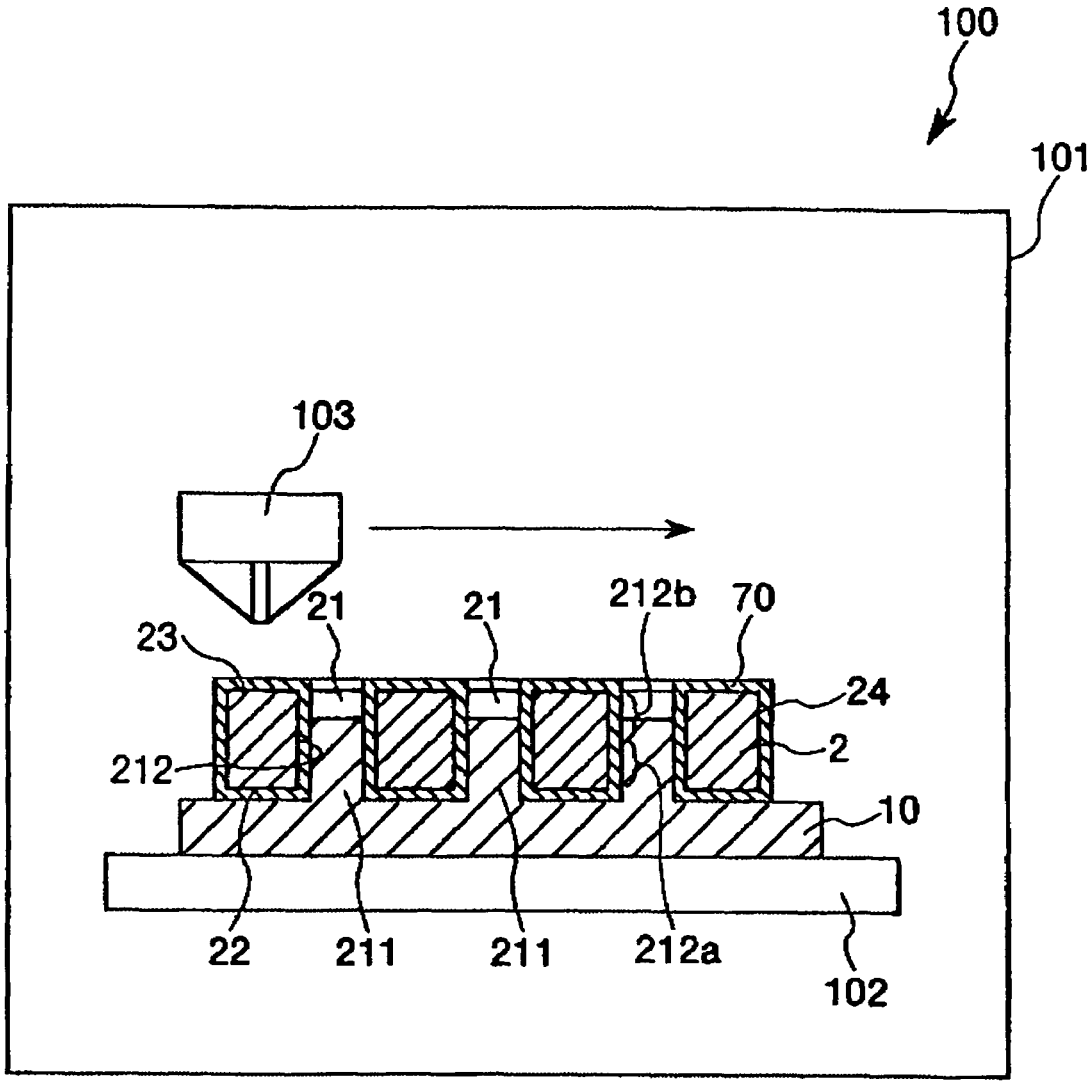
FIG. 5 is a view which illustrates a method of producing the ink-jet head shown in FIG. 1.

FIGS. 2 to 6 are views respectively illustrating a method of producing the ink-jet head shown in FIG. 1. Among these views, FIG. 2 is a top view of the nozzle plate incorporated in the ink-jet head. FIGS. 3 to 6 are vertical section views of the nozzle plate taken along line A-A in FIG. 1. In FIG. 5, an example of a plasma generating apparatus is shown schematically. It should be noted that the nozzle plate is shown upside down in FIGS. 3 to 6 as compared to the nozzle plate illustrated in FIG. 1. For the sake of convenience in description, the upper side in FIGS. 3 to 6 is referred to a "top", "upper" or its equivalents, and the lower side is referred to as "bottom", "lower" or its equivalents.

The ink-jet head producing method illustrated in FIGS. 3 to 6 comprises:

(i) Step of forming coat preform;

(ii) Step of attaching a sheet material on a surface of the nozzle plate;

(iii) Step of removing useless portions of the sheet material;

(iv) Step of removing the sheet material; and (v) Step of bonding plates.

The coating method according to the present invention is applied to the steps (i)-(iv) among the steps noted just above. Hereinafter, description for the above-listed steps will be given in sequence.

(i) Step of Forming Coat Preform (First Step)

Initially, as shown in FIGS. 2 and 3, a nozzle plate (base material) 2 is prepared, that has a plurality of nozzle holes 21 mutually spaced apart with a tiny spacing left therebetween. The nozzle plate 2 is made of, e.g., metal, ceramics, silicon, glass, plastics or the like. Among these materials, it is particularly desirable to use metals such as titanium, chromium, iron, cobalt, nickel, copper, zinc, tin and gold; alloys such as a nickel-phosphor alloy, a tin-copper-phosphor alloy (phosphor bronze), a copper-zinc alloy and stainless steel; polycarbonate; polysulphone; an ABS resin (acrylonitrile-butadiene-styrene copolymer); polyethylene terephthalate; polyacetal; or the like.

Subsequently, as shown in FIG. 4(*a*), a coat preform 70 for use in obtaining a liquid-repellent coat 7 is formed on the almost entire surface inside each nozzle hole 21 (that is, on a region including the partial region 212*a* of the inner surface 212), as well as on the external surface of the nozzle plate 2. The liquid-repellent coat 7 can be obtained by removing predetermined useless portions of the coat preform 70 at the step (iii) set forth below.

The coat preform 70 is formed by virtue of, e.g., a method of bringing a liquid containing the afore-mentioned materials for the liquid-repellent coat 7 into contact with the nozzle plate 2; Chemical Vapor Deposition (CVD) methods such as a plasma CVD a thermal CVD and a laser CVD; and dry plating methods such as a vacuum deposition, a sputtering and an ion plating. Among these methods, it is desirable to form the coat preform 70 by the method of bringing the liquid material into contact with the nozzle plate 2 (liquid-phase coating method). Using the liquid-phase coating method makes sure that the coat preform 70 can be formed in an easy and reliable manner. In the liquid-phase coating method, the nozzle plate 2 can be brought into contact with the liquid by, e.g., dipping the nozzle plate 2 into the liquid (dipping method); applying the liquid on the nozzle plate 2 (application method); or showering the nozzle plate 2 with the liquid.

(ii) Step of Attaching Sheet Material onto Surface of the Nozzle Plate (Second Step)

First, as illustrated in FIG. 4(*b*), a sheet material 10 for protecting the coat perform 70 is attached onto the surface 22 of the nozzle plate 2 (that is, onto the surface of the nozzle plate 2 where the ink-ejecting apertures 211 are provided) coated with the coat preform 70 so that a part of the sheet material 10 is placed into the nozzle holes 21 of the nozzle plate 2.

The attachment of the sheet material 10 to the nozzle plate 2 may be carried out using a machine such as a laminator, a vacuum laminator, or a press machine.

The sheet material 10 may have stickiness or adhesiveness in itself so that the sheet material 10 can be attached to the nozzle plate 2 without using a sticky agent or adhesive. Alternatively, the sheet material 10 may not have any stickiness or adhesiveness in itself so that the sheet material 10 is attached to the nozzle plate 2 using a sticky agent or adhesive.

Among these types, a sheet material 10 having stickiness or adhesiveness in itself, in particular stickiness, is preferably used. By using such a sheet material 10 having stickiness or adhesiveness in itself, it is possible to attach the sheet material 10 to the nozzle plate 10 reliably. In particular, by using a sheet material 10 having stickiness in itself, it is possible to detach or remove the sheet material 10 from the nozzle plate 2 easily and reliably in the following step (iv).

In this regard, it is to be noted that since the coat of the present embodiment is formed into a liquid-repellent coat, adhesion between the sheet material 10 and the coat preform 70 is relatively low(week). Therefore, it is possible to use a sticky sheet or adhesive sheet having high stickiness or adhesiveness as the sheet material 10.

In this case, examples of a sticky agent used for the sticky sheet material 10 include a rubber-based sticky agent, an acryl-based sticky agent, a vinyl-based sticky agent, and a silicone-based sticky agent, and they can be used alone or in combination with two or more of them.

On the other hand, examples of an adhesive agent used for the adhesive sheet material 10 include a rubber-based adhesive agent, an acryl-based adhesive agent, a vinyl-based adhesive agent, and a silicone-based adhesive agent, an epoxy-based adhesive agent, a urethane-based adhesive agent, and a hot-melt adhesive, and they can be used alone or in combination with two or more of them.

Further, as described above, the sheet material 10 is provided to protect the coat preform 70 from the plasma etching in the subsequent step (iii), and therefore the sheet material 10 itself may be either of the type which is gradually removed by the plasma or which is not essentially removed by the plasma.

In this embodiment, since the sheet material 10 used is of the type that can be removed by the plasma, a part of the sheet material 10 is packed into the nozzle holes 21 so as to cover the coat preform 70 provided in the regions including partial regions 212*a*, that is, so as to cover the coat preform 70 provided in the partial regions (specific regions) 212*a* and a part of the coat preform 70 provided in the regions 212*b* other than the partial regions 212*a*. In this case, since the sheet material 10 is not required to have resistance to the plasma as described above, there is an advantage in that the range of choices of materials that can be used for the sheet material 10 is expanded.

In this regard, it is to be noted that in a case where the sheet material 10 used is of the type that is not essentially removed by the plasma, it is sufficient that the sheet material 10 is packed into the nozzle holes 21 so as to cover only the coat preform 70 provided on the partial regions 212*a*.

Next, as shown in FIG. 4(*c*), the nozzle plate 2 is placed on a support stage 102 of a plasma processing apparatus 100 in such a manner that the sheet material 10 attached to the nozzle plate 2 lies at the bottom side. Configuration of the plasma processing apparatus 100 will be described later.

In this case, if the sticky or adhesive sheet material 10 is used, there is an advantage in that the nozzle plate 2 can be fixed onto the support stage 102 without using any other fixing means.

In a case where a sheet material 10 which does not have stickiness or adhesiveness on its surface to be faced to the support stage 102 is used, a support stage 102 of the type that has a mechanism for attracting the nozzle plate 2 is used. Examples of such an attracting mechanism include an electrostatic attracting mechanism, a magnetic attracting mechanism, a vacuum attracting mechanism, and the like.

In this case, instead of the attracting mechanism described above, a fixing mechanism of the type that holds the outer periphery of the nozzle plate 2 from the top side thereof may be used.

Further, in the case where a desired plasma processing can be carried out, the nozzle plate 2 may be simply placed on the support stage 102 without fixing it onto the support stage 102.

It is to be noted that as the sheet material 10, one which comprises a sheet base made of a resin or paper and a sticky resin layer or adhesive resin layer laminated on the sheet base may be used.

(iii) Step of Removing Useless Portions of Coat Preform (Third Step)

In this step, a plasma processing (plasma etching) is carried out onto the nozzle plate 2 from the side opposite to the ink-ejecting apertures 211 of the nozzle holes 21 (that is, from the other end side of the nozzle holes 21).

FIG. 5 shows one example of a plasma processing apparatus for use in removing predetermined useless portions of the coat preform 70. As shown in FIG. 5, the plasma processing apparatus 100 is provided with the support stage 102 on which the nozzle plate 2 is placed, and a plasma generating head 103 which supplies plasma onto regions of fine size. Both of the support stage 102 and the irradiating head 103 are accommodated within a chamber 101.

The plasma generating head 103 is kept spaced apart a predetermined spacing from the nozzle plate 2 which is placed on the support stage 102. Further, the plasma generating head 103 can be operated to move in a direction generally parallel to the top surface 23 of the nozzle plate 2.

The plasma generating head 103 may be either of the type which comprises an ion source for generating plasma, an ion source drawing electrode and an accelerating electrode for accelerating plasma (mainly ions) generated by the ion source toward an object to be processed (that is, the nozzle plate 2 on which the coat preform 70 is formed), or of the type which comprises a discharge electrode on an surface facing an object to be processed and a counter electrode provided on the support stage 102, so that plasma is generated between the discharge electrode and the counter electrode.

By using the plasma generating apparatus 100, the coat preform 70 formed on the upper surface 23 of the nozzle plate 2 and the coat preform 70 formed on the regions 212*b* of the inner surfaces 212 of the nozzle holes 21 other than the partial regions 212*a* thereof are removed. In order to remove the preform 70, the plasma generating head 130 is turned on and then it is moved in a direction generally parallel to the top surface 23 of the nozzle plate 2.

In this regard, it is to be noted that instead of moving the plasma generating head 103 in a direction generally parallel to the top surface 23 of the nozzle plate 2, the support stage 120 may be moved or both of them may be relatively moved. Namely, it is sufficient that the plasma generating head 103 is relatively movable with respect to the support stage 102.

Further, in addition to or instead of the moving mechanism, there may be provided with a rotary mechanism for revolute or rotate the plasma generating head 103 or the support stage 102.

Furthermore, the number of the plasma generating head 103 is not limited to one, and a plurality of plasma generating heads 103 may be provided. In this regard, it is to be noted that if the useless portions of the coat preform 70 can be removed uniformly over the entire of the nozzle plate 2, it is not necessary to provide such a plasma generating head moving mechanism as described above.

When plasma is supplied from the plasma generating head 103 onto the upper surface 23 of the nozzle plate 2, the coat preform 70 formed on the upper surface 23 of the nozzle plate 2 is removed by the plasma etching.

Further, when plasma is supplied into the nozzle holes 21, the coat preform 70 formed on the inner surfaces of the nozzle holes 21 and exposed above the sheet material 10 is removed by the plasma etching. At this time, the sheet material 10 existed in the nozzle holes are gradually removed from the upper portion thereof. In accordance with the removal of the sheet material 10, a part of the coat preform 70 which has been covered by the sheet material 10 is exposed from the upper side thereof. The coat preform 70 which has been exposed from the sheet material 10 is also removed from the inner surfaces 212 of the nozzle holes 21 by the plasma etching.

When the plasma is being supplied continuously over a predetermined time, the coat preform 70 formed on the regions 212*b* above the partial regions 212*a* is removed with leaving the coat preform 70 formed on the partial regions 212*a* as it is.

By subjecting the entire of the upper surface 23 of the nozzle plate 2 and each nozzle hole 21 to the plasma processing as described above, the useless or unnecessary coat preform 70 is removed while the coat preform 70 formed on the surface 22 of the nozzle plate 2 in which the ink-ejecting apertures 211 are provided, the side surfaces 24 and the partial regions 212*a* of the inner surfaces 212 of the nozzle holes 21 is left as it is. In this way, a liquid-repellent coat 7 is obtained.

Further, in the above nozzle plate 2, the liquid-repellent coat 7 is partially formed on the inner surface 212 of each nozzle hole 21 in the longitudinal direction of the hole 21 so as to form a portion where the liquid-repellent coat 7 is present to provide a liquid-repellent region having a low wettability against ink and a portion where the liquid-repellent coat is absent (has been removed) to provide a liquid-hydrophilic region having high wettability against ink. In this embodiment, by adjusting the amount of the removal of the sheet material 10 existed in each nozzle hole 21 in this step (iii), it is possible to determine the position of the boundary between the liquid-repellent region and the liquid-hydrophilic region in a suitable manner.

In this regard, it is to be noted that the coat preform 70 formed of the side surfaces 24 of the nozzle plate 2 may be removed as needed.

Examples of plasma that can be used in this plasma processing include oxide plasma, argon plasma, atmospheric plasma, and the like.

In a case where the plasma processing is carried out using oxide plasma, a mixture gas containing an oxide gas and an inactive gas (such as argon gas) is used as a gas for generating plasma. In this case, it is preferred that the flow rate of each of the oxide gas and the inactive gas, an output of radio frequency wave, and moving speed of the plasma generating head 103 are determined so as to be their optimum conditions taking into account various factors such as the materials of the coat preform 70 and the sheet material 10, the size of the regions from which the coat preform 70 is to be removed, and bonding property to the cavity plate described later.

The ambient atmosphere in the chamber 101 may be under an atmospheric pressure or a reduced pressure. Namely, the plasma processing may be carried under either of an atmospheric pressure or a reduced pressure.

In a case where the plasma processing is carried out under the atmospheric pressure, a vacuum pump becomes unnecessary, which results in the advantage that the manufacturing cost of the nozzle plate 2 can be reduced, and therefore the manufacturing cost of the ink jet head 1 can also be reduced. On the other hand, in a case where the plasma processing is carried out under the reduced pressure, it is possible to generate plasma easily and reliably. Further, since a decomposed matter of the coat preform 70 is likely to spread into the atmosphere in which the processing is carried out, it is possible to remove the decomposed matter from the nozzle plate 2 more reliably.

In this regard, it is to be noted that although the above embodiment uses the plasma processing for removing the useless portion of the coat preform 70, but the present invention is not limited to it, and an ultraviolet irradiation processing may be carried out instead of the plasma processing or both the ultraviolet irradiation processing and the plasma processing may be carried out.

In the case where the ultraviolet irradiation processing is carried out, the wavelength of the ultraviolet rays should preferably be no greater than 400 nm.

Further, the irradiation of the ultraviolet rays may be carried out under the atmospheric pressure or the reduced pressure. In a case where the ultraviolet ray irradiation processing is carried out under the atmospheric pressure, it is possible to reduce the manufacturing cost of the ink jet head 1 as described above. On the other hand, in a case where the ultraviolet ray irradiation processing is carried out under the reduced pressure, it is possible, to reduce an amount of vapor within the chamber 101 (that is, within the ambient atmosphere in which the processing is carried out), it is possible to prevent appropriately the irradiated ultraviolet rays from being absorbed by the vapor to be attenuated. As a result, it is possible to decompose and remove the useless portion of the coat preform 70 more effectively.

(iv) Step of Removing Sheet material (Fourth Step)

Figure 6A:
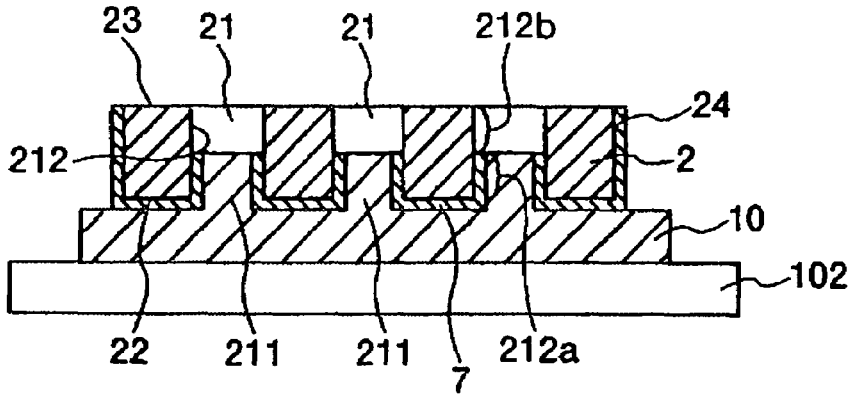
FIG. 6 is a view which illustrates a method of producing the ink-jet head shown in FIG. 1.
Figure 6B:
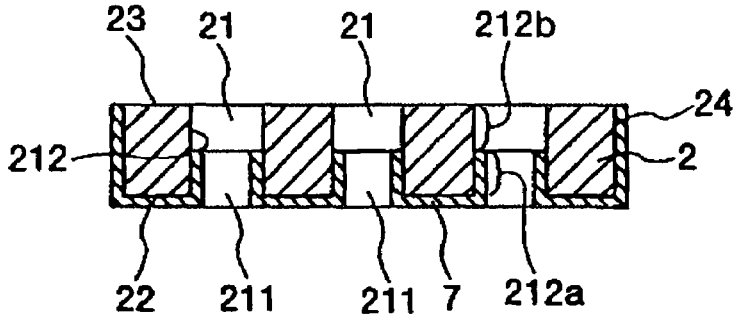

The nozzle plate 2 is taken out from the support stage 102, and the sheet material 10 is peeled off from the nozzle plate 2, after which the sheet material 10 left in the nozzle holes 21 is removed as shown in FIG. 6(*b*).

Going through the steps (i)-(iv) mentioned above, the liquid-repellent coat 7 is formed on predetermined regions of the nozzle plate 2. Forming the liquid-repellent coat 7 in this manner eliminates the need to use expensive substances such as a photosensitive resin material (resist material), thus reducing the costs involved in producing the liquid-repellent coat 7 to a great extent. Another beneficial effect is that the liquid-repellent coat 7 can be uniformly formed within a plurality of nozzle holes 21 in a lump.

Further, since the sheet material 10 remaining in the nozzle holes 21 can be also removed at one time, the workability is also good.

(v) Step of Bonding Plates (Fifth Step)

A cavity plate 3 and an electrode plate 4 are produced in advance and put in a condition for use. Then, the top surface of the nozzle plate 2 (that is, the opposite surface from the ink-ejecting apertures 211) is bonded to the surface of the cavity plate 3 in which steps are formed. Further, the surface of the electrode plate 4 on which electrodes 81 lie is bonded to the surface of the cavity plate 3 on which vibration diaphragms 31 are disposed.

Figure 7:
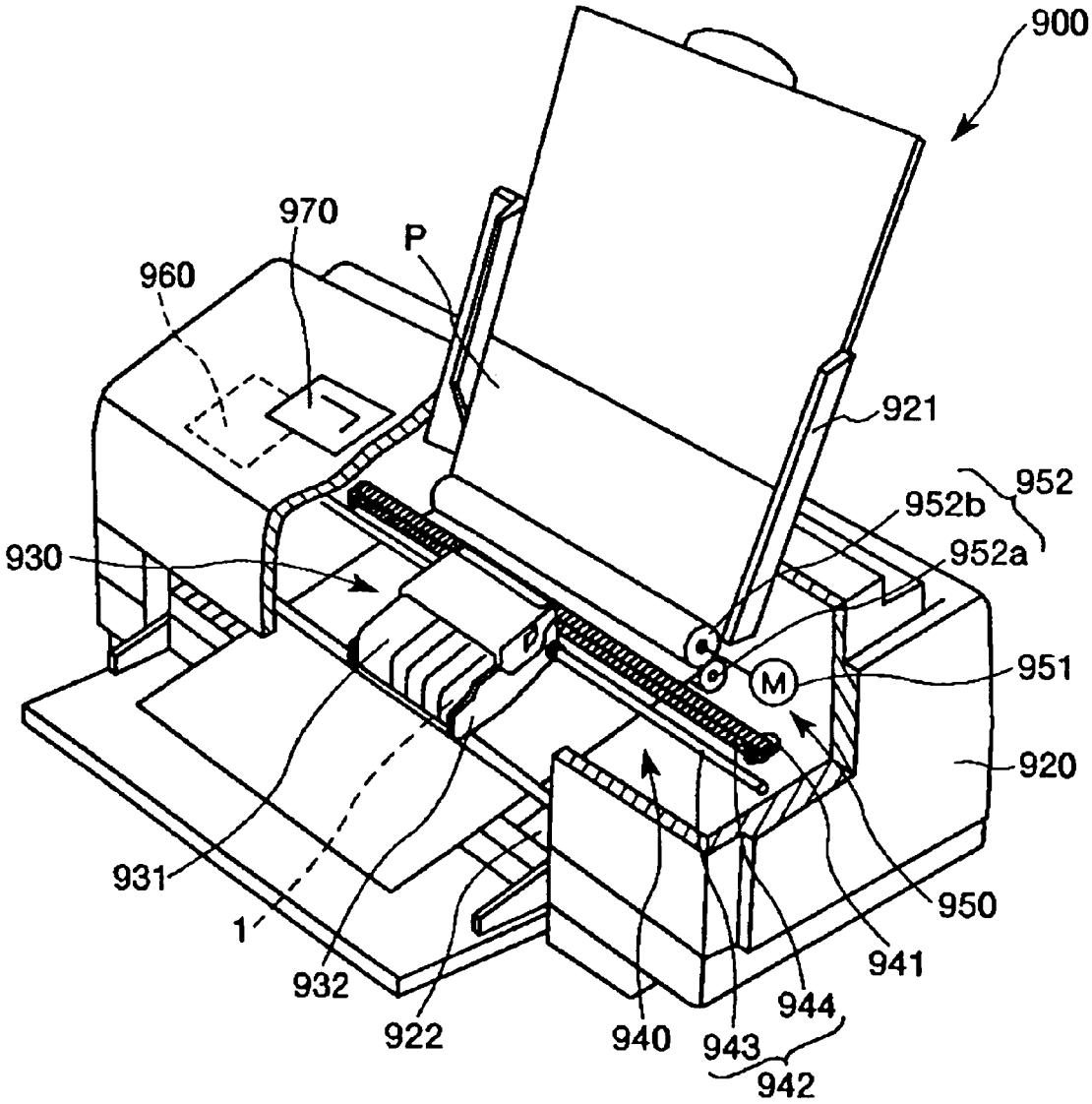
FIG. 7 is a schematic view showing an embodiment of an ink-jet printer which incorporates a liquid supplying apparatus according to the present invention.

Through the steps (i)-(v) described above, the ink-jet head 1 is manufactured. The ink-jet head 1 thus obtained is mounted to an ink-jet printer (a liquid supplying apparatus of this invention) shown in FIG. 7. FIG. 7 is a schematic view showing an embodiment of an ink-jet printer which incorporates the liquid supplying apparatus according to the present invention.

The ink-jet printer 900 illustrated in FIG. 7 is provided with a main body 920 that has a tray 921 for holding printing papers P at the top rear part; a discharge opening 922 for discharging the papers P therethrough at the bottom front part; and a manipulation panel 970 at the top surface.

The manipulation panel 970 includes, e.g., a liquid crystal display; an organic EL display; an LED lamp; a display part (not shown) for indicating error messages and other information; and an operation part (not shown) with a plurality of switches.

Provided within the main body 920 are a printing device (printing means) 940 having a reciprocating head unit 930; a sheet feeder (paper feeding means) 950 for feeding the papers P toward the printing device 940 in a sheet-by-sheet manner; and a control unit (control means) 960 for controlling the printing device 940, the sheet feeder 950 and other devices.

In response to an instruction from the control unit 960, the sheet feeder 950 intermittently feeds the papers P sheet by sheet, so that each paper P passes through beneath the head unit 930. At this time, the head unit 930 is caused to reciprocate in a direction generally orthogonal to the paper feeding direction, whereby printing is performed in the process of feeding each paper P. In other words, the reciprocating movement of the head unit 930 and the intermittent feeding of the papers P play a role of primary movement and a role of secondary movement in the printing process, respectively, thereby performing an ink-jet printing operation.

The printing device 940 comprises, in addition to the head unit 930, a carriage motor 941 for driving the head unit 930, and a reciprocator mechanism 942 for causing the head unit 930 to reciprocate in response to the rotation of the carriage motor 941. The head unit 930 comprises an ink-jet head 1 having the nozzle holes 21 (ink-ejecting apertures 211) at its bottom side; an ink cartridge 931 for supplying ink to the ink-jet head 1; and a carriage 932 which carries both of the ink-jet head 1 and the ink cartridge 931. The ink cartridge 931 contains ink of four colors, i.e., yellow, cyan, magenta and black, for the purpose of full color printing. The reciprocator mechanism 942 comprises a carriage guide shaft 944 whose opposite ends are supported on a frame (not shown), and a timing belt 943 extending in a parallel relationship with the guide shaft 944. The carriage 932 is reciprocatingly supported by the guide shaft 944 and also fixedly attached to a part of the timing belt 943.

When energizing the carriage motor 941, the timing belt 943 is caused to run in a forward or reverse direction by rotation of a pulley, whereby the head unit 930 reciprocates along the guide shaft 944. In the process of the reciprocating movement, the ink-jet head 1 ejects ink in an appropriate manner to perform printing on the paper P.

The sheet feeder 950 is provided with a feeding motor 951 for driving the sheet feeder 950 and feeding rollers 952 rotated in response to the operation of the feeding motor 951. The feeding rollers 952 comprises a driven roller 952*a* and a driving roller 952*b* which is operatively connected to the feeding motor 951. Both of the rollers 952*a* and 952*b* are disposed one on top the other in a mutually confronting relationship with a nip to feed the papers P left between the rollers 952*a* and 952*b*. This arrangement assures that the feeding rollers 952 can feed, in a sheet-by-sheet manner, the papers P held on the tray 921 toward the ink-jet head 1. In place of the tray 921, it would be possible to detachably mount a sheet-feeding cassette for storage of the papers P.

In response to the instruction received from a host computer (e.g., a personal computer, a digital camera and the like), the control unit 960 controls the printing device 940, the sheet feeder 950 and other devices to perform the printing operation.

Although not shown in the drawings, the control unit 960 generally comprises a memory for storing control programs for controlling each section of the printer; a drive circuit for applying pulse voltages to each electrode 81 of the ink-jet head 1 to control the ink ejecting timing; a drive circuit for driving the printing device 940 (carriage motor 941); a drive circuit for driving the sheet feeder 950 (feeding motor 951); a communication circuit for receiving printing data from the host computer; and a CPU connected to these components for performing various control operations. In addition, the CPU is further connected to a variety of sensors such as a sensor for detecting the residual quantity of ink in the ink cartridge 931; a sensor for detecting the position of the head unit 930.

When the printing data is received via a communication circuit from the host computer, the memory stores the received printing data in response to the instruction from the control unit 960. The CPU processes the stored printing data, and then each of the drive circuits generates drive signals based on the processed printing data and other data received from the sensors. In response to the drive signals from the drive circuits, an electrostatic actuator, the printing device 940 and the sheet feeder 950 perform their own operations, so that the printing can be done on the papers P.

Although the coating method, the liquid supplying head and the liquid supplying apparatus according to the present invention have been described in the foregoing in respect of the illustrated embodiment, it should be noted that the invention is not limited to the particular embodiment disclosed herein.

For example, the coat that can be formed by the coating method of the present invention is not limited to the liquid-repellent coat, and may comprise other kinds of coats. If needed, the coating method of the present invention may include additional steps for other purposes.

Further, the liquid supplying head of the present invention may be applied to different kinds of heads that have a flow passageway (through-hole) as in a variety of dispensing nozzles, for instance.

Finally, it is to be understood that many changes and additions may be made to the embodiments described above without departing from the scope and spirit of the invention as defined in the appended Claims.

What is claimed is:

1. A coating method for forming a coat on a base material having at least one through-hole, the through-hole having an inner surface between one end and the other end thereof, the coat being formed on at least a predetermined partial region of the inner surface of the through-hole, the partial region of the inner surface running a predetermined length from the one end of the through-hole toward the other end, the method comprising the steps of:

forming a coat preform to be processed into the coat on a region including the partial region of the inner surface of the through-hole;

attaching a sheet material for protecting the coat preform to one surface of the base material in which the one end of the through-hole is provided so that a part of the sheet material is packed into the through-hole to cover the coat preform provided on a region of the inner surface of the through-hole which includes the predetermined partial region;

subjecting the base material to plasma processing and/or ultraviolet ray irradiating processing from the side of the base material where the other end of the through-hole is provided to remove the coat preform exposed from the sheet material while removing the sheet material which covers the coat preform other than the partial region by the plasma and/or ultraviolet ray irradiating processing and leaving the coat preform on the predetermined partial region as it is; and removing the sheet material from the base material by peeling off the sheet material from the base material.

2. The coating method as claimed in claim 1, wherein the coat preform is formed from a liquid which contains a constituent of the coat.

3. The coating method as claimed in claim 1, wherein the plasma and/or ultraviolet ray irradiating processing is carried out under an atmospheric pressure.

4. The coating method as claimed in claim 1, wherein the plasma and/or ultraviolet ray irradiating processing is carried out under a reduced pressure.

5. The coating method as claimed in claim 1, wherein an average area of the through-hole at the one end thereof is 50-40,000 $\mu m^2$.

6. The coating method as claimed in claim 1, wherein the sheet material has stickiness or adhesiveness.

7. The coating method as claimed in claim 1, wherein in the coat preform forming step the coat preform is formed on the inner surface of the through-hole and the external surface of the base material so that the coat is formed on the partial region of the inner surface of the through-hole and the one surface of the base material in a continuous manner.

* * * * *